United States Patent [19]

Rieffel

[11] Patent Number: 4,821,431

[45] Date of Patent: Apr. 18, 1989

[54] SANDAL WITH CONTAINED GRANULAR MATERIAL TO PROVIDE A PAD FOR A PERSON'S FOOT

[76] Inventor: Donald W. Rieffel, 3402 E. Seneca, Tucson, Ariz. 85716

[21] Appl. No.: 192,165

[22] Filed: May 10, 1988

[51] Int. Cl.[4] ..... A43B 11/00; A43B 1/00

[52] U.S. Cl. ..... 36/88; 36/1

[58] Field of Search ..... 36/1, 43, 58.5, 88, 36/89, 91, 92, 93

[56] References Cited

U.S. PATENT DOCUMENTS

| | | | |
|---|---|---|---|
| 1,257,086 | 2/1918 | Marcellus | 36/88 X |
| 1,954,122 | 4/1934 | Fiori | 36/88 X |
| 2,400,023 | 5/1946 | Potter | 36/1 X |
| 3,235,981 | 2/1966 | Kloss | 36/58.5 |
| 3,464,125 | 9/1969 | Conway | 36/58.5 X |
| 3,472,508 | 10/1969 | Baker et al. | 36/83 X |
| 4,227,320 | 10/1980 | Borgeas | 36/88 |
| 4,550,511 | 11/1985 | Gamm | 36/91 X |

*Primary Examiner*—Donald Watkins

*Attorney, Agent, or Firm*—J. Michael McClanahan

[57] ABSTRACT

Footwear consisting of a sandal having a plenum adapted to receive the person's foot as well as sand or other granular material, said sand providing a natural environment walking surface between the bottom of the person's foot and the sandal mid-sole, the footwear also having a bottom sole to engage the ground, the bottom sole a part of a lower surrounding cup-like shell with upraised heel part adapted to receive and secure the mid-sole, the upper rim portions of the lower shell providing means for securing a toe strap, heel strap, and instep strap, the instep strap and toe strap being loose and not contacting the foot while the person is standing but contracting the foot when the footwear is lifted up along with the foot. The footwear completely encloses the person's foot by continuing above the forward portion of the lower shell with an upper cover, and finally a plastic top closure material to engage the person's ankle. The described invention permits the free movement of the contained granular material allowing it to re-form and continually conform to the shape of the person's foot as the person utilizes the sandal in walking, and to thereby provide a healthful and comfortable article of footwear.

14 Claims, 2 Drawing Sheets

FIG. 1
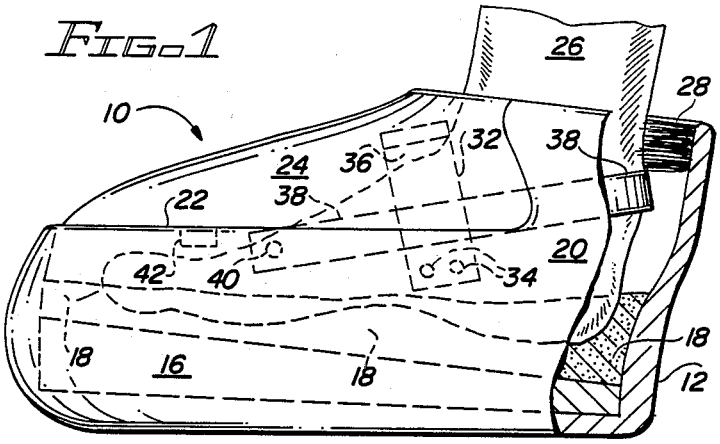
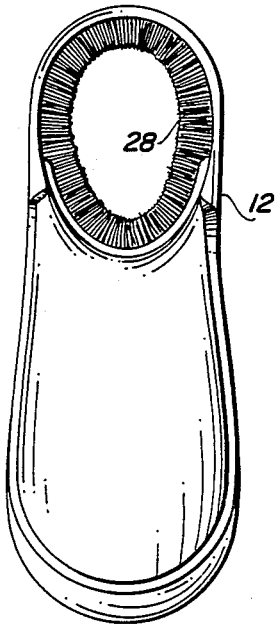
FIG. 6
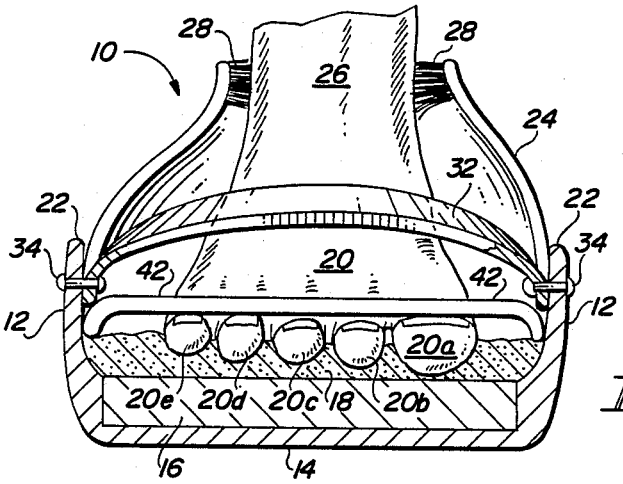
FIG. 2
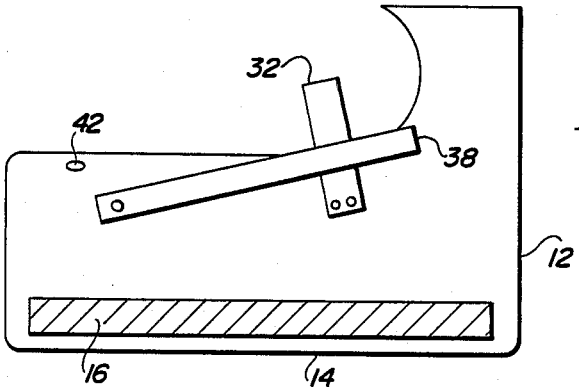
FIG. 5
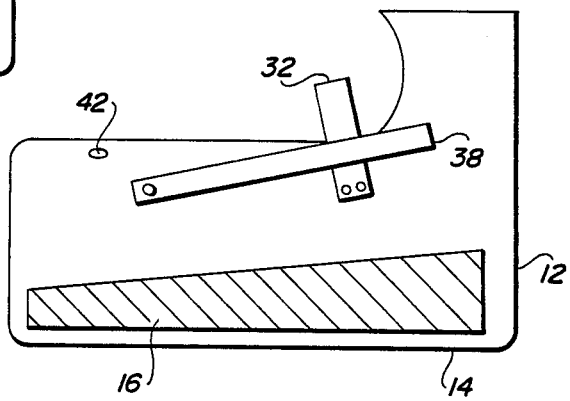
FIG. 6

SANDAL WITH CONTAINED GRANULAR MATERIAL TO PROVIDE A PAD FOR A PERSON'S FOOT

BACKGROUND OF THE INVENTION

1. Field of the Invention

The field of the invention is novel sandals which contain freely shifting sandy or granular material for a person to walk on wherein the sand or granular material may conform to the person's foot as the sandal is being worn.

2. Description of the Related Art

Shoes and sandals which are available to the consumer today are very restrictive to the person's foot because, among other reasons, the footwear is designed to grasp and hold the person's foot and to a large extent, require the foot to conform to the particular style of footwear. This is most apparent in stylish women's and ladies' shoes.

Obviously the best footwear, both from the point of view of comfort and health, would be footwear which conforms to the shape of the foot so that the foot is equally supported at all portions with regard to the amount of weight each portion of the foot is pressing down upon the surface that the foot engages. Perhaps one of the best examples of healthful and comfortable surfaces for a bare foot to walk on is a sandy beach where the resulting imprint of the foot and depth of the track is indicative of the different pressure points on the sole of the foot.

It is the intent of the invention described herein to present sandal footwear which most closely resembles the surface upon which one walks if one was to walk on a sand covered beach. The sandal is designed to recreate the original and natural environmental walking surface that man walked upon before the advent of the universal wearing of footwear, and thus allows modern man to carry that walking surface to his bare feet in urban situations. By this means, comfortable, restful, and healthful footwear is provided allowing a pleasurable experience for the wearer.

Accordingly, it is apparent that there is great value in a relatively low cost, comfortable, and healthful footwear which carries its own sand, or other granular material, with it in a containment envelope, and which allows the material to conform to the bottom of the wearer's foot as pressure is placed upon the foot.

SUMMARY OF THE INVENTION

This invention relates to a novel sand or other granular material containing sandal footwear which permits a wearer to walk on the natural granular surface with the bare foot while also providing the bare foot with maximum freedom from restraint and which conveys the granular medium walking surface with the footwear as one walks.

More specifically, an article of footwear is provided consisting of means to provide a base support for a layer of granular material upon which the wearer's foot contacts. A mid-sole is encapsulated within a lower shell, the lower shell also having a sole portion immediately beneath the mid-sole and is the portion which contacts the ground surface as the described footwear is being used. The lower shell defines an elongated cup-like structure having a front end and a heel end, and perpendicularly extending sides rising up from the bottom sole portion. The lower shell surrounds the enclosed mid-sole and continues to a point above the top surface of the mid-sole in the front end portion of the sandal and further continues upward in the rear or heel end to the full height of the sandal and to partially surround the ankle.

Continuing from the top rim of the forward portion of the lower shell, an upper cover continues upward to encapsulate the forward portion of a person's foot, leaving, together with the rear portion of lower shell, an opening to receive the foot. Lastly, the containment envelope is complete by utilizing a plastic bristle like top closure to engage the person's ankle, the plastic top closure made of material completely sealing the sandal to the ankle and preventing the escape of granular material.

Interiorly to the resulting plenum formed by the top of the mid-sole, the sides of the lower shell, the upper cover and the plastic top ankle engaging material are the foot containing straps which secure the footwear to the person's foot. Three straps are incorporated into the footwear to secure a person's foot, all three straps attached to the upper portions of the lower shell. Near the front, a toe strap is fastened at the upper front portion of the lower shell, from side to side but at a position above the toes such that even with the layer of sand or granular material between the person's foot and the mid-sole, the toe strap will not engage the top of the person's foot when the person is standing in the sandals. The toe strap is secured to the upper portion of the lower shell by an appropriate adhesive or a fastening means, such as sewing, a rivet, or the like.

The other two straps which secure the described footwear to the wearer are the heel strap and the instep strap. The heel strap attaches to the upper portion of the lower shell by means of oppositely situated pivotal rivets. The points at which the heel strap connect to the upper portion of the lower shell is immediately behind (relative to the front or toe of the sandal) the toe strap. The heel strap is attached so as to provide a pivot in order that it may rotate up and down as the person's heel moves up and down relative to the mid-sole of the sandal.

The last strap used to secure the person's foot to the inventive sandal, i.e., the instep strap, is adapted to surround very loosely the person's instep. This strap is secured in the rear portion of the upper part of lower shell, on the interior of the shell and is so sized so that under most circumstances, even with a layer of granular material between the bottom of a person's foot and the top of the mid-sole, the person's foot instep does not contact the instep strap when the person is standing on the ground in the sandals. The instep strap does however contact the person's instep when the sandal is raised by the person raising their foot. In addition, if desired for comfort, compressible foam or other type of compressible plastic may be inserted on the underside of the instep strap in the location of the person's instep.

All three straps, i.e., the toe, heel, and instep strap, attach to the upper portion of the lower shell at points within the lower shell.

Lastly, it is anticipated that the sandal is constructed of a size so that the mid-sole upon which a person's foot rests (with the layer of granular material in between) is substantially wider than the person's foot, perhaps in the order of a half inch or more on each side, and also the mid-sole should be a half inch or more longer on each end than the person's foot. Even although the purpose of making the sandal larger than a person's foot is to avoid unduly confining of the foot, yet it is anticipated that perhaps only three or four different sizes will be necessary to fit the adult population.

Lastly, the inventive sandal provides a plurality of different elongated block type mid-soles, a flat mid-sole of the same thickness from front to rear, and a mid-sole shaped in the form of a wedge with the incline running from the front to the rear, and from the rear to the front.

It is an object of the subject invention to provide a novel sandal containing granular material interposed the person's foot and a contained mid-sole, the granular material constantly adjusting to conform to the shape of a person's foot as a person walks in the sandal.

It is another object of the subject invention to provide a comfortable article of footwear giving the feeling of walking on sand, and non-confining to a person's foot.

It is still another object of the subject invention to provide an article of footwear which provides a healthy and safe receptacle for a person's foot.

Other objects of the invention will in part be obvious and will in part appear hereinafter. The invention accordingly comprises the apparatus comprising the construction, combination of elements, and arrangement of parts which are exemplified in the following detailed disclosure and the scope of the Application of which will be indicated in the Claims.

BRIEF DESCRIPTION OF THE DRAWINGS

For further understanding of the nature and objects of the present invention, reference should be had to the following detailed description taken in conjunction with the accompanying drawings wherein:

FIG. 1 is a side view of the preferred embodiment of the subject invention showing the interior parts of the sandal with a backward sloping mid-sole;

FIG. 2 is a front view of the preferred embodiment of the subject invention with the front portion of the sandal removed to reveal the interior elements as seen from the front;

FIG. 4 is a side view of the subject invention showing an alternate embodiment of the mid-sole; and FIG. 5 is a side view of the subject invention showing a second alternate embodiment of the mid-sole.

FIG. 6 is a top view of the subject invention showing the plastic top closure.

In various views, like index numbers refer to like elements.

DETAILED DESCRIPTION OF THE PREFERRED EMBODIMENT

Figure 3A:
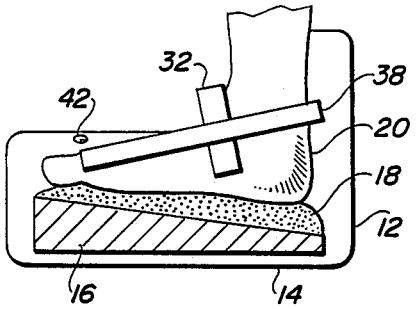
FIG. 3 comprises four sub-Figures, namely FIGS. 3.*a*. through 3.*d*., which show a side view of the subject invention detailing the movement of the contained granular material while walking.

Referring now to FIG. 1, a side view of the subject footwear is shown wherein the elements interiorly to the sandal which permits the wearer to walk on a natural environment granular surface are detailed in dotted form. More specifically, footwear sandal 10 shown in FIG. 1 consists of the following major elements, namely, a one piece lower shell which includes a sole and consists of an upper situated lower shell 12 with the bottom sole 14, bottom sole 14 adapted to provide the base of the sandal which touches the ground or sidewalk and which supplies support to the granular material containment mechanism. The lower shell defines an elongated cuplike structure having a front end (or front portion), a heel end (or heel or rear portion), and perpendicularly extending sides rising up from the sole. As seen in FIG. 1, the heel portion sides rise up higher than the front portion sides. In the preferred embodiment, the lower shell with sole may be constructed of one piece of somewhat flexible plastic, such as polyvinylchloride (PVC), and manufactured by injection molding or other appropriate process.

Held within the lower part of cup-like structure lower shell and sole is an elongated mid-sole 16 which is inserted into the lower shell and is adapted to receive on its top surface the granular material and then the person's foot. Mid-sole 16 also has a front end and heel end which correspond to the lower shell front end and heel end. This mid-sole is preferably constructed of material which is resilent, i.e., is compressible, but bounces back, such as a polyethylene foam. If desired or needed, an adhesive may hold mid-sole 16 in place. Immediately above mid-sole 16 is situated the loose granular material such as sand or the like upon which the person's foot 20 is adapted to rest. As is obvious from the inherent characteristics of loose granular material, the granular material will conform to the shape of the person's foot such that support of the foot on all portions of the bottom is provided, even for those persons having a high arch.

Attached to the top rim portion 22 of the forward portion of lower shell 12 is the upper cover 24 which rises above lower shell 12 to surround but not touch the toes and instep of foot 20 belonging to the person wearing the inventive sandal. At the very top of upper cover 24 and on the inside is a plastic top closure (not shown) adapted to bridge the distance between the top of upper cover 24 and ankle 26 of the person. The plastic top closure also attaches to the inside top part of the heel portion of lower shell 12. Both the upper cover and the lower shell heel portion combine to form an opening to receive the plastic top closure. The plastic top closure is made of material having a large number of inwardly directed bristles which provide the function of completely closing off the plenum formed (when the foot is inserted) to prevent the granular material 18 from being thrown out of the inventive sandal as the person walks or makes various movements with their foot.

Upper cover 24 is secured to the inside portion of the upper part of the forward portion and the heel portion of lower shell 12 by an adhesive or other fastening means such as by sewing. Similarly, the plastic top closure material is attached to upper cover 24 and shell 12 heel portion by an adhesive or other fastening means such as by sewing.

Providing means to secure the inventive sandal to the person's foot 20 are three flexible foot straps, all straps permanently attached to the upper forward portions of the lower shell 12. These straps comprise firstly instep strap 32 (shown dotted) which is adapted to loosely surround the instep portion of the foot 20. Each end of instep strap 32 is permanently affixed to opposite side of the upper forward portion of lower shell 12 proximate the heel receiving area of mid-sole 16 by rivets 34 or other appropriate means, such as by sewing. As shown in FIG. 1, considerable room is allowed between the top of the person's instep and the bottom portion of instep strap 32 immediately proximate the instep to permit the foot 20 to pivot upwards from its toe portion during times of walking or other moving around. If desired, a piece of soft, easily compressible, foam 36 may be glued to the inside portion of instep strap 32, the soft foam adapted to engage, or nearly engage, the foot instep. Instep strap 32 crosses from side to side within lower shell 12 and upper cover 24 and is attached at both ends.

Also attached to the top portion of the forward part of lower shell 12 is heel strap 38 which surrounds the heel of the person's foot 20 in a rather snug, but not discomforting, holding grip. Heel strap 38 pivots about rivet 40 so that as the foot flexes and pivots upward from the toe portion of the foot, heel strap 38 will pivot upward to follow the foot, continually encircling the heel. Both pivoting rivet 40 and the securing rivets 34 penetrate through the upper portion of lower shell 12. Like instep strap 32, heel strap 38 crosses from side to side within the plenum formed by lower shell 12 and upper cover 24 and is pivotally attached at each end at a point forward of the instep strap attachment point. While it is realized that the preferable method of attachment of heel strap 38 is by a single rivet at each end, yet since the strap is constructed of a flexible material, so each end could be permanently attached. As such, the strap would still flex to permit pivoting of the foot, although the strap may become slightly tighter as the foot pivots upward.

Lastly, toe strap 42 crosses transversely the person's foot 20 proximate the toe area, toe strap 42 attached at opposite sides on the inside forward portion of lower shell 12. Toe strap 42 provides the mechanism which carries the front portion of the sandal along when it is lifted upward by the person lifting his foot up. All three straps are preferably made from nylon webbing, although other types of plastic materials or leather may be used.

In the preferred embodiment shown in FIG. 1, it is noted that the elongated block which forms mid-sole 16 is wedge shaped, the wedge slope increasing in thickness from the heel of the person's foot to the area of the toes. With the design of mid-sole 16 shown in FIG. 1, there will always be a tendency for granular material 18 shown in FIG. 1 to return to the rear portion of the inventive sandal which counteracts any tendency of the granular material to move forward and collect in the forward portion of the inventive sandal while it is being worn.

As can be seen from the embodiment shown in FIG. 1, each time that the person walks and as the person pivots his foot upward from the toe portion, the granular material or sand 18 will at all times be taking on new shapes such that when the person puts his foot down, the granular material or sand receives the foot and moves around such as to conform to the shape of the foot with every step. It is intended that the sand should be loose at all times and that each time that the person takes a step, the sand rearward of the toe area will be in constant movement so as not to be restrictive or confining to the foot such as a conventional shoe may be. For that reason, it is suggested that perhaps a powdered desiccant or dry lubricant, such as talc, silicon, or teflon, may be added to the granulated material so as to prevent the granulated material from forming clumps or hardening due to moisture or the like which may be present upon the foot or generated by the foot.

Obviously also, with the containment plenum formed, granular material inside the sandal will remain interiorly and little, if any at all, will be lost as the person moves around. It is also an obvious requirement that the materials which comprise the inventive sandal should be somewhat flexible, and especially so the outer materials such as the lower shell and sole, as well as the upper cover materials completing the containment envelope. It is also apparently obvious that it is to the advantage of the invention that the upper cover is preferably made from a breathable type material, such as cotton, canvas, leather, or a porous polyester fabric, for example, the "cordura" type fabric.

Continuing, FIG. 2 is a front view of the inventive sandal providing means to contain the granular particles where the upper front portion of the containment envelope has been removed in order to afford a clear view of the elements of the invention contained within the lower shell and the upper cover. Starting from bottom sole 14, mid-sole 16 is seen immediately above. Next, granular particles 18, which may comprise sand as desired, are shown interposed mid-sole 16 and the bottom portion of foot 20 represented by the plurality of toes numbered *20a–20e*. Immediately above the toes and the front portion of foot 20 is toe strap 42 which stretches from side to side interiorly to lower shell 12, toe strap 42 being attached at both sides by an adhesive, sewing, rivets, or other fastening means. Proceeding upwardly and back, immediately above toe strap 42 is instep strap 32 which has its ends located in the mid to rear portion of the lower shelf 12 (but prior to the uprising heel portion) and which resides above the person's instep, not contacting the instep until the foot is pivoted upward from the toe portion. The pad 36, which may be attached to the under part of instep strap 32 in FIG. 1, has been left off of the drawing in FIG. 2.

Next, connecting to the inside of the lower shell 12 is upper cover 24 shown rising up from the top rim 22 of the forward part of lower shell 12 to the point where it connects with the plastic top closure material 28 which is adapted to surround and engage the upper portions of the person's ankle 26. In order to keep FIG. 2 uncluttered and yet show as much as feasible, heel strap 38 which attaches forward of instep strap 32 on lower shell 12 to encircle the heel of the person wearing the inventive sandals is not shown. Plastic top closure material 28 is attached to the upper most part of upper cover 24 and the upper most part of the heel portion of lower shell 12. Plastic top closure material 28 is brush like in appearance having a flexible backing with outward protruding soft bristles. It is one piece made from polyethylene plastic material. The backing is attached by sewing, an adhesive, or other means, to the top parts of upper cover 24 and lower shell 12. These types of brushes are currently available as surgical scrub brushes.

As the elements comprising the containment envelope are connected to each other by appropriate fastening means such as by sewing, an adhesive, riveting, or other desired connection means, it is necessary that the means of fastening utilized provide a continuous closure as it is intended that the formed plenum not have any openings through which the granular material inside the inventive sandal could leak out during time of wearing.

FIG. 6 shows a top view of the novel foot wear sandal detailing particularly the plastic top closure material 28 completely lining the top portion of the heel part of lower shell 12 and the top portion of upper cover 24. The backing of the plastic top closure material 28 is attached by an adhesive or sewing to the lower shell 12 and upper cover 24 with the bristles pointing inward. It is noted that at the forward portion of material 28, the bristles from opposite sides are engaging each other. It is anticipated that when a person places his foot into the opening formed centrally to the plastic top closure material 28, the bristles will bend down sufficiently to permit the entrance of the foot, and then the bristles enclose completely around the top portion of the ankle as shown in FIG. 2.

Figure 3B:
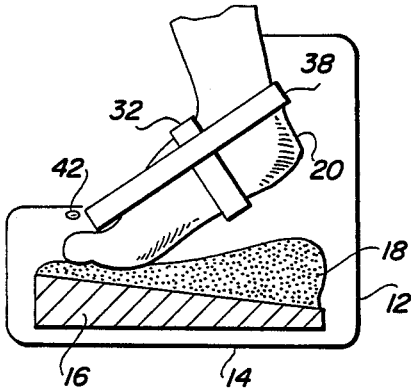
Figure 3C:
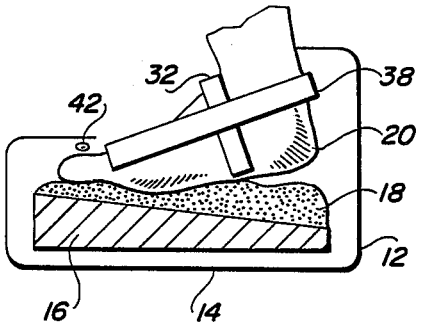
Figure 3D:
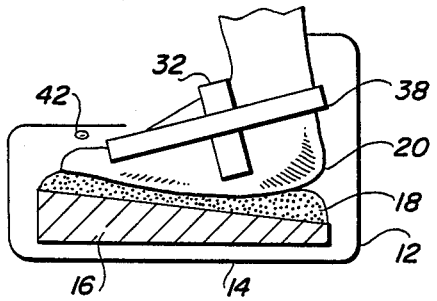

Referring now to FIG. 3, a series of four individual drawings illustrate the positional relationship of the person's foot to the inventive sandal as the person wearing the sandal goes through the operation of walking and therein lifting his foot upward and forward. The figures also illustrate the shift of the granular material during the process of walking and moving the sandal about. As earlier described, the tendency of the granular material is to move to the front portion of the sandal as the person maneuvers around or walks. Here, the mid-sole, in taking the wedged shape, tends to retain the granular material in the rear portion against its tendency to shift forward. In the four illustrations shown in FIG. 3, the upper cover is not shown and only the outline of the combined sole and lower shell is detailed to allow viewing of the sandal with its contained granular material together with the relationship of the heel, toe, and instep strap.

For example, in FIG. 3.*a*., the sandal is resting upon the ground and the granular material is fairly evenly distributed from the front to the rear underneath the foot 20 and above mid-sole 16. Instep strap 32 is at a point where it is not touching the top of foot 20 and heel strap 38 is at its lowest position, and toe strap 42 does not touch foot 20.

As the person starts to take a step (FIG. 3.*b*.), maximum pivoting of foot 20 about its toe portion takes place and space is created underneath the heel of foot 20 which permits the reception of more granular material 18. In addition, foot 20, in the toe section, has not yet contacted toe strap 42, but is pressing against mid-sole 16 such as to urge the granular material rearward. The sandal is carried upward as the instep of foot 20 is urged against instep strap 32 and at that time the instep strap is most heavily pressing against the person's instep and toe strap 42 engages foot 20 as the sandal is lifted and carried forward.

In FIG. 3.*c*. the person's foot is halfway in its stride forward and the foot is now not pivoted upwards as much as it was in FIG. 3.*b*. and the heel of the foot is now closer to the end portion of mid-sole 16.

As the person has completed the forward most portion of his stride (FIG. 3.*d*.), but prior to the sandal engaging the ground, the foot is coming back more into position upon the mid-sole 16 and the granular material has distributed itself more equally atop mid-sole 16.

Lastly, FIG. 3.*a*. shows the foot back on the ground with the foot now pressing upon the mid-sole 16 and upon the granular material interposed between the foot and the mid-sole 16. The granular material is evenly distributed and provides the natural environmental walking surface to the person's foot as intended.

Next, FIGS. 4 and 5 detail alternate embodiments of the invention with the mid-sole 16 taking a flat shape (same thickness, heel part to toe part) (FIG. 4) and a wedge shape such as shown in FIGS. 1–3 with the exception that the wedge slope is now in the opposite direction vis-a-vis the person's foot (FIG. 5). More specifically, in FIG. 4, mid-sole 16 rests upon sole 14 and is completely surrounded by lower shell 12. Here, like in FIG. 3, for illustrative purposes, lower shell 12 is shown rather box-like although it will be somewhat rounded at its opposite ends and near the top rim portion and the bottom sole portion. In addition, the upraised heel portion of lower shell 12 is not completely drawn so as to permit full revealing of the foot associated straps. Connected to lower shell 12 is the heel strap 38, toe strap 42, and the instep strap 32. Again, to visualize the relationship of the mid-sole 16 to the remainder of the elements in the drawing, all parts shown were shown in solid form. It is realized that both the heel strap 38, toe strap 42, and instep strap 32 are contained within the lower shell 12 and the containment envelope 24. In the drawing as shown in FIG. 4, the balance of the containment envelope, namely the upper cover and plastic top closure material, has been left off also to render the drawing clearer.

In FIG. 5, all the same elements are shown as in FIG. 4 with the exception that mid-sole 16 now is wedge shaped with the wedge pointing downward in the direction of the toes.

As previously discussed, sand will tend to collect in the forward toe portion of both the inventive sandals shown in FIGS. 4 and 5 rather than being evenly distributed over mid-sole 16 as was the case with the preferred embodiment shown in FIGS. 1–3. This will be especially accentuated in FIG. 5 as the slope of mid-sole 16 will tend to keep the granular material in the forward toe portion, requiring the foot to move the granular material backwards as the foot settles into position atop the mid-sole.

While sand has been suggested as granular material 18, it is realized that other types of granular material may be utilized such as, for example, glass beads. In addition to the desiccant which has been suggested may be added to the granular material, deodorants and/or anti-fungal medication may also be added. Lastly, while a slightly compressible material has been suggested for mid-sole 16, yet, it is within the realm of the invention to utilize a hard non-compressible material such as wood or non-resilient plastic. In fact, sandals are commercially available which utilize wood as the only material separating the wearer's foot from the ground.

While a preferred embodiment of the subject invention as been shown and described together with alternate embodiments, it will be understood that there is no intent to limit the invention by such disclosure, but rather it is intended to cover all modifications of the apparatus and alternate constructions falling within the spirit and the scope of the invention as defined in the appended claims.

I claim:

1. Footwear providing a natural environment walking surface for the bottom of a person's foot comprising:

a lower shell adapted to receive the person's foot;

a plurality of foot straps operably attached to said lower shell, said plurality of foot straps adapted to contain the person's foot; and granular material held within said lower shell interposed said lower shell and the bottom of the person's foot whereby the bottom of the person's foot contacts the granular material which provides the natural environment walking surface for the foot while the foot is contained within the lower shell.

2. The footwear as defined in claim 1 wherein said lower shell defines an elongated cuplike structure having a front end and a heel end, and a flat bottom sole with perpendicularly extending sides, said sides partially enclosing the person's foot.

3. The footwear as defined in claim 2 wherein said lower shell perpendicularly extending sides rise at said heel end of the elongated lower shell to form a heel portion, said perpendicularly extending sides of said heel portion of a greater height than said lower shell perpendicularly extending sides at said front end of said elongated lower shell.

4. The footwear as defined in claim 3 further including a mid-sole situated interiorly to said lower shell, said mid-sole also elongated and having a front end and a heel end corresponding to said elongated lower shell front end and heel end, and said mid-sole receiving said granular material.

5. The footwear as defined in claim 4 further including an upper cover, said upper cover operably attached to said lower shell perpendicularly extending sides at said front end, said upper cover surrounding the forward portion of the person's foot.

6. The footwear as defined in claim 5 wherein said upper cover and said lower shell heel portion combine to form an opening adapted to receive the person's foot and pass the foot interiorly to the footwear.

7. The footwear as defined in claim 6 further including a top closure, said top closure operably connected to said lower shell heel portion and said upper cover proximate said opening, said top closure surrounding and engaging the person's foot above the instep to seal the granular material inside the sandal from escaping.

8. The footwear as defined in claim 5 wherein said mid-sole comprises an elongated block having a thickness.

9. The footwear as defined in claim 8 wherein said mid-sole comprises a wedge having a thickness greater at the front end than at the heel end.

10. The footwear as defined in claim 8 wherein said mid-sole comprises a wedge having a thickness greater at the heel end than at the front end.

11. The footwear as defined in claim 5 wherein said plurality of foot containing straps include a heel strap adapted to surround the person's heel, an instep strap adapted to encompass the instep of the person's foot, and a toe strap adapted to pass over the toes of the person's foot.

12. The footwear sandal as defined in claim 5 wherein said granular material comprises sand.

13. The footwear sandal as defined in claim 5 wherein said granular material comprises glass beads.

14. The footwear sandal as defined in claim 5 wherein said granular material includes a dessicant.

* * * * *